US007195533B2

(12) United States Patent
Hasegawa

(10) Patent No.: US 7,195,533 B2
(45) Date of Patent: Mar. 27, 2007

(54) METHOD FOR FABRICATING ENVELOPE AND METHOD FOR FABRICATING IMAGE DISPLAY APPARATUS

(75) Inventor: Mitsutoshi Hasegawa, Kanagawa-Ken (JP)

(73) Assignee: Canon Kabushiki Kaisha, Tokyo (JP)

( * ) Notice: Subject to any disclaimer, the term of this patent is extended or adjusted under 35 U.S.C. 154(b) by 224 days.

(21) Appl. No.: 11/099,579

(22) Filed: Apr. 6, 2005

(65) Prior Publication Data

US 2005/0233669 A1 Oct. 20, 2005

(30) Foreign Application Priority Data

Apr. 15, 2004 (JP) ..... 2004-120208

(51) Int. Cl.
*H01J 9/00* (2006.01)
*H01J 9/46* (2006.01)

(52) U.S. Cl. ..... 445/24; 445/25

(58) Field of Classification Search ..... 445/24, 445/25

See application file for complete search history.

(56) References Cited

U.S. PATENT DOCUMENTS

| | | | | |
|---|---|---|---|---|
| 6,060,113 | A | 5/2000 | Banno et al. | 427/78 |
| 6,210,245 | B1 | 4/2001 | Sando et al. | 445/6 |
| 6,220,912 | B1 | 4/2001 | Shigeoka et al. | 445/24 |
| 6,254,449 | B1 | 7/2001 | Nakanishi et al. | 445/25 |
| 6,309,691 | B1 | 10/2001 | Hasegawa et al. | 427/8 |
| 6,390,873 | B1 | 5/2002 | Banno et al. | 445/6 |
| 6,419,746 | B1 | 7/2002 | Banno et al. | 118/323 |
| 6,506,089 | B2 | 1/2003 | Nakanishi et al. | 445/25 |
| 6,511,358 | B2 | 1/2003 | Banno et al. | 445/24 |
| 6,511,545 | B2 | 1/2003 | Banno et al. | 118/688 |
| 6,514,559 | B1 | 2/2003 | Miyamoto et al. | 427/78 |
| 6,624,586 | B2 | 9/2003 | Abe et al. | 315/169.1 |
| 6,685,982 | B2 | 2/2004 | Hasegawa et al. | 427/8 |
| 6,761,925 | B2 | 7/2004 | Banno et al. | 427/78 |
| 6,815,001 | B1 | 11/2004 | Mishima et al. | 427/8 |
| 6,821,551 | B2 | 11/2004 | Hasegawa et al. | 427/8 |
| 6,879,096 | B1 | 4/2005 | Miyazaki et al. | 313/495 |
| 7,070,471 | B2 * | 7/2006 | Shiokawa et al. | 445/24 |
| 2003/0058192 | A1 | 3/2003 | Arai et al. | 345/59 |
| 2003/0067263 | A1 | 4/2003 | Tokioka et al. | 313/493 |
| 2004/0124426 | A1 | 7/2004 | Hasegawa et al. | 257/82 |
| 2004/0135505 | A1 | 7/2004 | Hasegawa | 313/553 |
| 2004/0213897 | A1 | 10/2004 | Miyamoto et al. | 427/58 |
| 2005/0082963 | A1 | 4/2005 | Miyazaki et al. | 313/493 |

FOREIGN PATENT DOCUMENTS

| | | |
|---|---|---|
| JP | 11-135018 | 5/1999 |

* cited by examiner

*Primary Examiner*—Joseph Williams
(74) *Attorney, Agent, or Firm*—Fitzpatrick, Cella, Harper & Scinto

(57) ABSTRACT

The present invention provides a method for fabricating an envelope, which has a high freedom of process, is economical and allows an easy process management. The method aims to fabricate an envelope formed by sealing first and members, the envelope having a vacuum space therein, and basically comprises a step of baking the first and second members in vacuum in a first chamber, a carrying step of carrying the first and second members subjected to baking from the first chamber to a second chamber in an atmosphere in which an air having a predetermined dew point is maintained at a temperature exceeding such dew point, and a sealing step of sealing the first and second members in vacuum in the second chamber thereby forming the envelope. The method allows to economically provide an image display device and an image display apparatus of satisfactory display quality.

7 Claims, 14 Drawing Sheets

METHOD FOR FABRICATING ENVELOPE AND METHOD FOR FABRICATING IMAGE DISPLAY APPARATUS

BACKGROUND OF THE INVENTION

1. Field of the Invention

The present invention relates to a method for fabricating an envelope for maintaining a vacuum interior, and a method for fabricating an image display apparatus utilizing the method for fabricating the envelope.

2. Related Background Art

An electron emitting device has been known in two types of a hot electron source and a cold cathode electron source. The cold cathode electron source includes an electric field emission device (FE device), a metal/insulator/metal device (MIM device), a surface conduction electron emitting device (SCE device) etc.

FIG. 12 schematically shows an envelope 91 utilizing an electron source substrate, in which such electron emitting devices (an surface conduction electron emitting device being shown as an example) are arranged in a matrix shape. A rear plate 93 is a glass substrate provided, on one side thereof, with an electron source substrate 131 on which a plurality of surface conduction electron emitting devices 132 are arranged. The electron emitting device 132 is provided with a pair of device electrodes, which are respectively connected to an X-direction wiring 133 and a Y-direction wiring 134. A face plate 92 is formed by a glass substrate 121, bearing, on an internal surface thereof, a fluorescent film 122, a metal back 123 etc. Between the face plate 92 and the rear plate 93, a supporting frame 94 is provided to secure a predetermined space between the electron emitting device 132 and the fluorescent film 122/metal back 123. A getter (not shown) of an evaporation type or a non-evaporation type is provided on an image display area of the face plate 92, or the electron source substrate 131 of the rear plate 93, or on both glass substrates. Between the face plate 92 and the rear plate 93, a support member (not shown) called a spacer may be further provided. Presence of such spacer allows to form an envelope 91 having a sufficient strength to the atmospheric pressure even in case of a large-area panel.

FIG. 13A shows an example of a procedure of fabricating the envelope (for example cf. Japanese Patent Application Laid-open No. H11-135018). For forming the envelope 91, at first a face plate 92 and a rear plate 93 are prepared (step 101). In this state, a support frame 94 is adhered in advance to the face plate 92 by frit glass, and, in case of employing a spacer, such spacer is adhered and fixed to the rear plate 93. Then, as a panel adjoining material, an In film (not shown) is coated by soldering on the support frame 94 and the rear plate 93 (step 102). In order to improve the adhesion strength of the support frame 94 and the rear plate 94 to the In film, a silver paste film may be provided as an undercoat layer (not shown). Also a sufficient adjoining strength can be obtained by a soldering with an ultrasonic soldering iron. Then the face plate 92 and the rear plate 93 are carried to a sealing apparatus, and are subjected to a vacuum baking (step 103). Then a getter activation process is executed under vacuum (step 104), and then the support frame 94 and the rear plate 93 are adjoined and sealed across the In film at a temperature equal to or higher than the melting point of In, thereby completing an envelope 91 (step 105).

However, the vacuum baking step and the sealing step executed in a same chamber result in a drawback of an elongated process time required for temperature regulation and the like. Therefore, an improvement in the fabrication efficiency is achieved by executing these steps in different chambers. FIG. 13B shows an example of such fabricating process. Steps 111 and 112 and same as the aforementioned steps 101 and 102. After a vacuum baking step (step 113), the face plate 92 and the rear plate 93 are carried to a sealing apparatus capable of executing the getter process (step 114), in which a getter step and a sealing step are executed (steps 115, 116). In this process, in order that the face plate 92 and the rear plate 93 subjected to a dehydration and a degassing in the vacuum baking step are not recontaminated by an impurity or water in the course of carrying, thereby resulting in a loss of vacuum level, the carrying is executed in vacuum or in an inert gas atmosphere such as a $N_2$ atmosphere.

However, such prior process is associated with following drawbacks. Firstly, the In coating step cannot be executed effectively in vacuum because of In scattering, and has to be executed prior to the baking step because the steps of baking and thereafter are all executed in vacuum in the prior technology, so that the process lacks freedom.

Also the spacer provided on the rear plate is heated to a high temperature by vacuum baking, and a rapid temperature change induces a bending of the rear plate and a cracking of the spacer. Thus, there are required measures against the cracking of the spacer, such as a temperature control by upper and lower heaters at the carrying operation, involving a difficulty in the temperature control and an increased cost of the apparatus. On the other hand, a carrying in an inert gas atmosphere also requires measures for preventing oxygen deficiency or choking around the carrying facility, resulting in a difficult process control and an increase in the facility cost.

SUMMARY OF THE INVENTION

An objective of the present invention is to provide a method for fabricating an envelope, which has a high freedom in process, is economical and allows an easy process management.

To attain the aforementioned objective, the present invention provides, in a first aspect thereof, a method for fabricating an envelope formed by sealing first and second members, the envelope having a vacuum space therein. The fabricating method basically includes a step of baking the first and second members in vacuum in a first chamber, a carrying step of carrying the first and second members subjected to baking from the first chamber to a second chamber in an atmosphere in which an air having a predetermined dew point is maintained at a temperature exceeding such dew point, and a sealing step of sealing the first and second members in vacuum in the second chamber thereby forming the envelope.

In the fabricating method of the present invention, it is preferable that the predetermined dew point is selected equal to or lower than 0° C., that the maximum temperature in the sealing step is lower than the maximum temperature of the baking step, and that the air temperature in the carrying step is lower than the maximum temperature in the baking step.

It is more preferable to further include a step of forming a getter on the image forming member either in the course of the carrying step or before the sealing step.

In a second aspect, a fabricating method of the present invention can be utilized for fabricating an image display apparatus including an envelope having a first member and a second member opposed to each other, the envelope having a vacuum space therein, and a matrix-shape wiring and an image forming member provided in the envelope. In this case, the envelope is fabricated by the aforementioned serial steps, namely by a step of baking the first and second members in vacuum in a first chamber, a carrying step of carrying the first and second members subjected to baking from the first chamber to a second chamber in an atmosphere in which an air having a predetermined dew point is maintained at a temperature exceeding such dew point, and a sealing step of sealing the first member and the second member in vacuum in the second chamber thereby forming the envelope.

More specifically in this fabricating method, the matrix-shape wiring is connected to a plurality of electron emitting devices, and the image forming member includes a phosphor and an electron accelerating electrode.

The fabricating method of the present invention, employing the aforementioned specific steps in the fabrication of the envelope, can attain the aforementioned objective of the invention and can economically provide an image display device and an image display apparatus of a satisfactory display quality.

DETAILED DESCRIPTION OF THE PREFERRED EMBODIMENTS

Figure 1A:
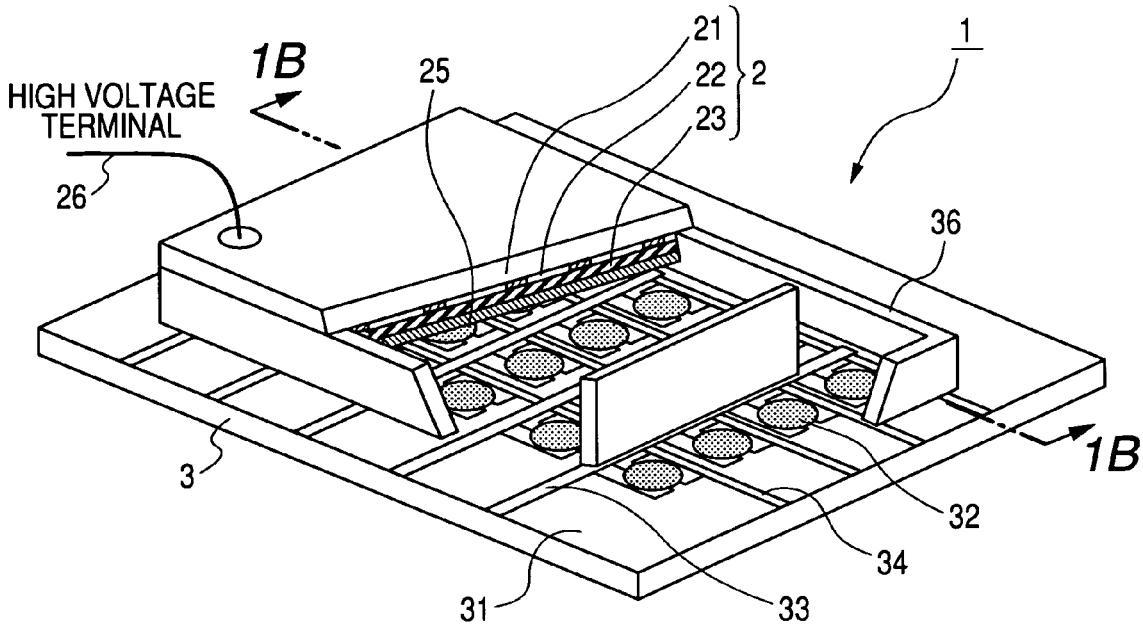
FIGS. 1A and 1B are respectively a schematic perspective view and a cross-sectional view of an envelope of the invention.

The present invention has been made in consideration of the aforementioned drawbacks, and provides a method for fabricating an envelope formed by sealing a first member and a second member and containing a vacuum space therein. The fabricating method for the envelope of the present invention includes a step of baking the first member and the second member in vacuum in a first chamber, a carrying step of carrying the first member and the second member thus baked from the first chamber to a second chamber in an atmosphere in which an air having a predetermined dew point is maintained at a temperature exceeding such dew point, and a sealing step of sealing the first member and the second member in vacuum in the second chamber thereby forming the envelope. In the baking step, the first member and the second member may be baked simultaneously or separately. Also in the carrying step, the first member and the second member may be carried simultaneously or separately.

In such fabricating method for the envelope, a carrying of the first member and the second member from the first chamber to the second chamber is executed in an air atmosphere of a temperature higher than a dew point, thereby preventing deposition of unnecessary substances such as moisture in the course of carrying, and improving the vacuum level in the envelope. In particular, the present invention allows to execute the carrying step, that has been executed in vacuum or in an inert gas atmosphere, in a high-temperature dry air atmosphere, thereby dispensing with special facilities and safety measures and is therefore advantageous in economicality and in process management. Also in case a sealing material is required to be coated for sealing the first member and the second member and cannot be coated in vacuum, the present invention enables such coating in the course of or after the carrying step, whereby the process has a wider freedom.

The predetermined dew point is preferably 0° C. or lower, and the maximum temperature in the sealing step and the air temperature in the carrying step are preferably lower than the maximum temperature in the baking step.

The fabricating method for the envelope of the present invention is applicable to an image processing apparatus requiring an internal vacuum space, wherein the first member is for example a rear plate, having a matrix-shape wiring, of the image processing apparatus, and the second member is for example a face plate, having an image forming member, of the image processing apparatus.

In order to secure the vacuum level in the envelope, there may be further included a step of forming a getter on the image forming member, in the course of the carrying step or before the sealing step.

Also the present invention provides a fabricating method for an image display apparatus including an envelope having a first member and a second member in a mutually opposed relationship and having a vacuum space therein, and a matrix-shape wiring and an image forming member provided in the envelope, wherein the envelope is fabricated by the aforementioned method.

In such image display apparatus, the matrix-shape wiring is connected plural electron emitting devices, and the image forming member includes a phosphor and an electron accelerating electrode. Also the electron emitting device is for example a surface conduction electron emitting device.

In the fabricating method for the envelope of the invention, as explained in the foregoing, a carrying to the second chamber for executing the getter step and the sealing step is executed in an air atmosphere of a temperature higher than a dew point to prevent deposition of unnecessary substances such as moisture in the course of carrying, thereby suppressing a loss in the getter characteristics and achieving an improvement in the vacuum level and a longer service life of the device. Also the fabricating method for the envelope of the invention, not requiring vacuum in the course of carrying, allows an In coating in the course of or after the carrying, thereby expanding the freedom of the process and reducing the cost of the apparatus. Furthermore, not requiring an inert atmosphere in the course of carrying the method allows a safer handling. It is thus rendered possible to provide more economically an image display device of a high electron emitting ability and an image display apparatus of a satisfactory display quality utilizing such image display device.

Figure 1B:
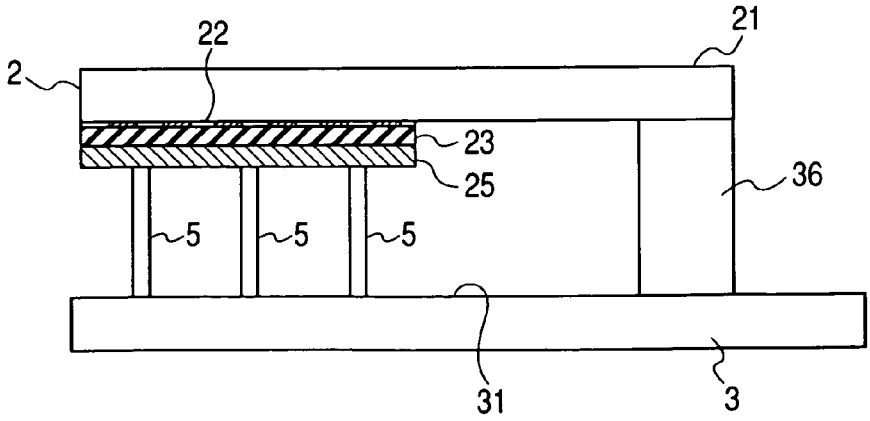

In the following there will be explained a schematic structure of an envelope relating to the fabricating method of the invention. FIGS. 1A and 1B are respectively a perspective view and a cross-sectional view along a 1B—1B line in FIG. 1A, showing a schematic structure of the envelope.

An envelope 1 is constituted of a rear plate 3 constituting a first member, a face plate 2 constituting a second member, a spacer 5 and the like.

The rear plate 3 has an electron source substrate 31 formed by a glass substrate provided with a plurality of surface conduction electron emitting devices 32. The electron emitting device 32 is provided with a pair of device electrodes (to be explained later), which are respectively connected to an X-direction wiring 33 and a Y-direction wiring 34. The X-direction wiring 33 and the Y-direction wiring 34 are preferably of a low resistance in order that substantially uniform voltages can be applied to the plural electron emitting devices 32, and are formed with a material, a thickness, a wiring width and the like selected suitably. A support frame 36 is provided along a periphery of the rear plate 3.

As shown in FIG. 1B, the face plate 2 is provided in an opposed relationship to the rear plate 2, and is formed by a glass substrate 21 in which a fluorescent film 22, a metal back 23 etc. are formed on an internal surface. The fluorescent film 22 and the metal back 23 are provided with a phosphor and an electron accelerating electrode and constitute an image display area. On the metal back 23, a getter 25 of evaporation type is formed. The getter 25 adsorbs a gas generated inside the envelope 1 thereby maintain the vacuum in the interior of the envelope 1, and is preferably distributed over the entire image display area. The face plate 2 is connected to a high-voltage terminal 26.

The support frame 36 is sealed to the face plate 2 to secure an adequate clearance between the electron source substrate 31 and the image display area, and constitutes a part of the envelope 1 as an adjoining member for the rear plate 3 and the face plate 2. The rear plate 3 and the electron source substrate 31 are adjoined by frit glass, and the support frame 36 and the face plate 2 are adjoined by In.

A spacer 5 is provided between the face plate 2 and the rear plate 3 to construct the envelope 1 of a sufficient strength against the atmospheric pressure even in a large-area panel.

Figure 2A:
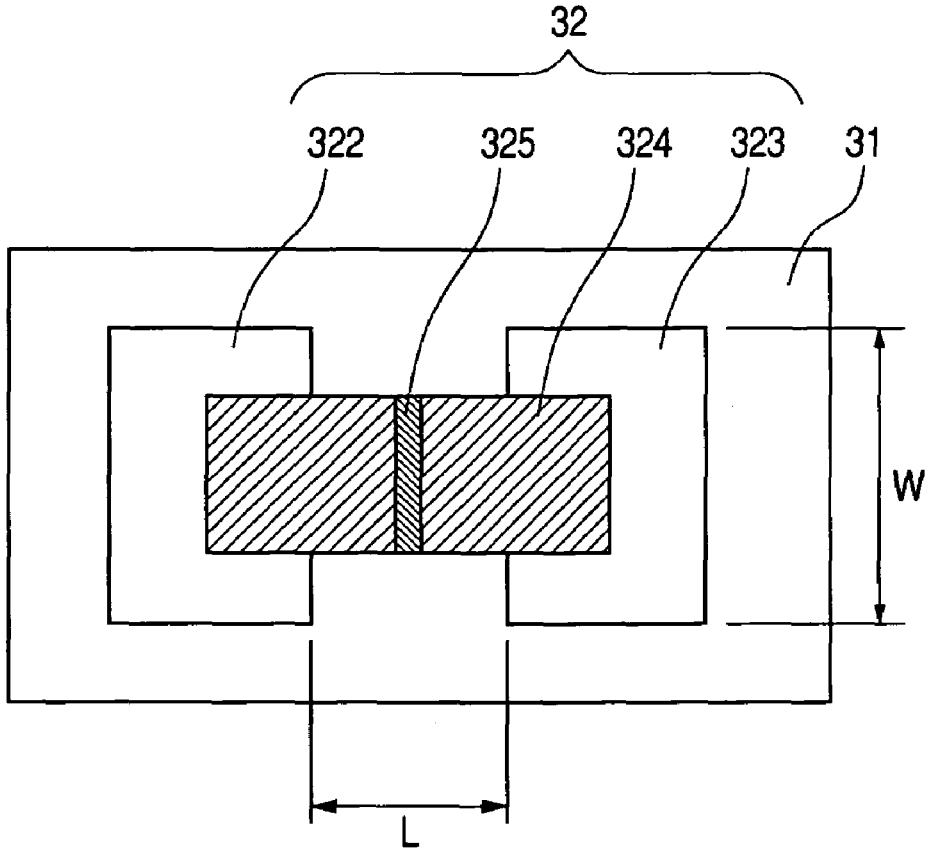
FIGS. 2A and 2B are detailed partial view of an electron emitting device of the envelope of the invention.
Figure 2B:
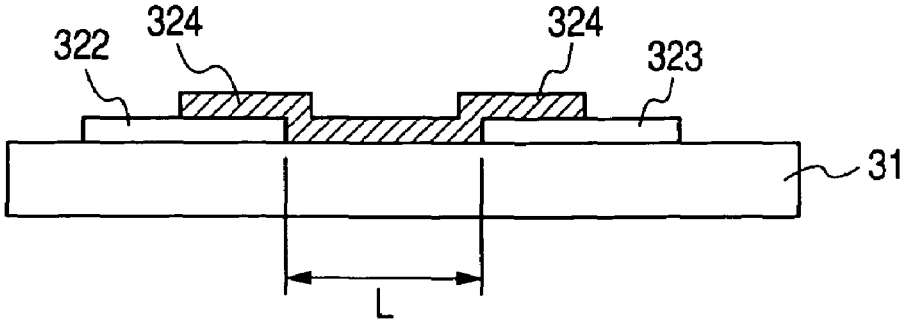

FIG. 2A is a magnified view of an installation area of an electron emitting device on the electron source substrate, and FIG. 2B is a cross-sectional view thereof. An electron emitting device 32 has a device structure of M. Hartwell, which is a typical device structure of the surface conduction electron emitting device. On the electron source substrate 31, there are provided two device electrodes 322, 323 between which an electroconductive film 324 constituting an electron source is provided. In a central portion of the electroconductive film 324, an electron emitting region 325 is provided. The two device electrodes 322, 323 are respectively connected to an X-direction wiring 33 and a Y-direction wiring 34 (cf. FIGS. 1A and 1B).

The electron source substrate 31 is formed for example by a glass, of which a size and a thickness thereof are suitably selected depending on a number of the electron emitting devices 32 to be provided thereon and a design and a shape of individual electron emitting devices 32, and also on mechanical conditions such as of a structure withstanding an atmospheric pressure, in order to maintain vacuum in the envelope in case the electron source is used as a part of such envelope. For such glass, an inexpensive soda lime glass is commonly employed, but in such case it is necessary to form a silicon oxide film of a thickness of 0.5 μm by sputtering as a sodium blocking layer. Also a glass of a low sodium content or a quartz substrate may be employed.

The device electrodes 322, 323 may be constituted of an ordinary electroconductive material, which is suitably selected advantageously from a metal such as Ni, Cr, Au, Mo, Pt or Ti or an alloy such as Pd—Ag, or a printed conductor formed by a metal oxide and glass, or a transparent conductor such as ITO. They have a thickness preferably within a range from several tens of nanometers to several micrometers.

In the device electrodes 322, 323, a gap L, an electrode length W, and a shape thereof are suitably designed according for example to a state of actual application of the device, but the gap L is preferably from several hundred nanometers to 1 mm, and more preferably within a range of 1 to 100 μm in consideration of a voltage applied between the device electrodes 322, 323. Also the length W of the device electrode is preferably within a range of several to several hundred micrometers in consideration of a resistance and electron emitting characteristics of the device electrodes 322, 323.

An electroconductive film 324 is particularly preferably formed by a fine particulate film constituted of fine particles for obtaining satisfactory electron emitting characteristics. A film thickness is suitably selected in consideration of a step coverage on the device electrodes 322, 323, a resistance therebetween and a condition of a forming process to be explained later, but is preferably within a range of several hundred picometers to several hundred nanometers, and particularly preferably 1 to 50 nm. According to the investigation of the present inventors, palladium is generally suitable as the material of the electroconductive film, but it is not restrictive.

For the purpose of simplicity in illustration, the electron emitting region 325 is illustrated as a rectangular shape at the center of the electroconductive film 324, but this is just a schematic illustration and an actual electron emitting region may be different in a position and a shape.

Figure 3A:
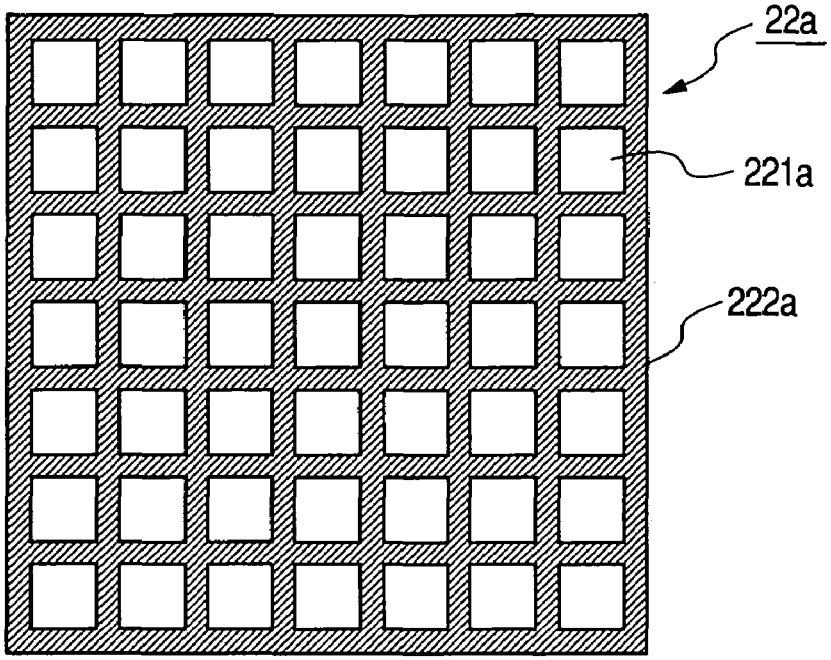
FIGS. 3A and 3B are schematic plan views of a fluorescent film in the envelope of the invention.
Figure 3B:
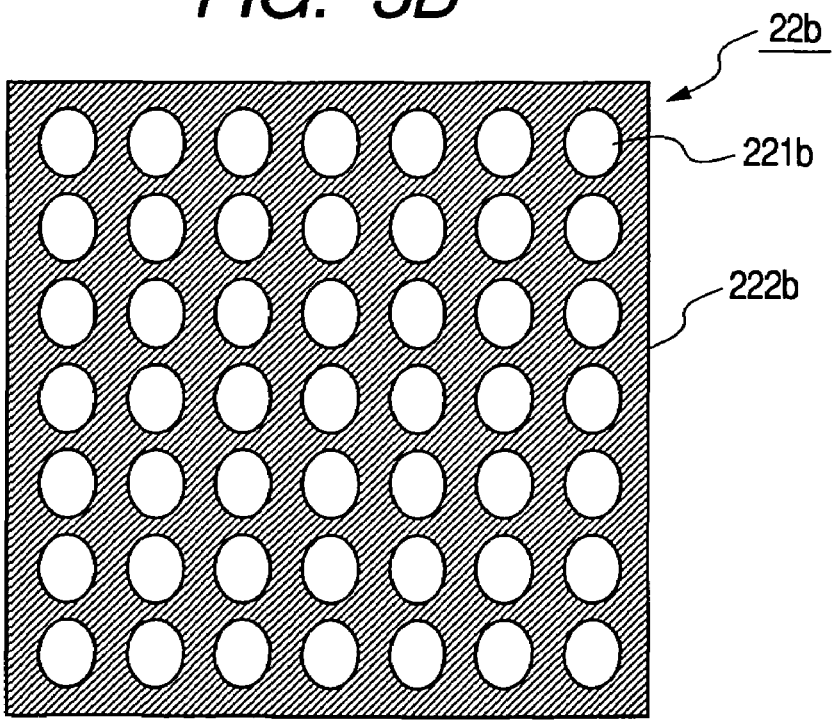

FIGS. 3A and 3B are schematic plan views of a fluorescent film. The fluorescent film can be realized in various patterns, as exemplified in FIGS. 3A and 3B. The fluorescent film 22 is solely constituted of a phosphor in case of a monochromic fluorescent film, but, in case of a color fluorescent film, is constituted of a black electroconductive material 222*a* (or 222*b*) called black stripes or a black matrix depending on an arrangement of phosphor, and phosphors 221*a* (or 221*b*). The black stripe or the black matrix is provided for forming black boundary portions between the phosphors 221*a* (or 221*b*) of three primary colors required in a color display thereby rendering a color mixing inconspicuous, and for suppressing a loss in the contrast caused by a reflection of an external light by the fluorescent film 22.

The fluorescent film 22 is usually provided, on an internal surface thereof, with a metal back 23. The metal back 23 is an electroconductive film for example of Al, and is provided for mirror reflecting, among the light emitted from the phosphor, a light to the inside back toward the face plate 2 thereby increasing the luminance, and for serving as an electron accelerating electrode (anode) for applying an accelerating voltage to an electron beam.

Figure 4:
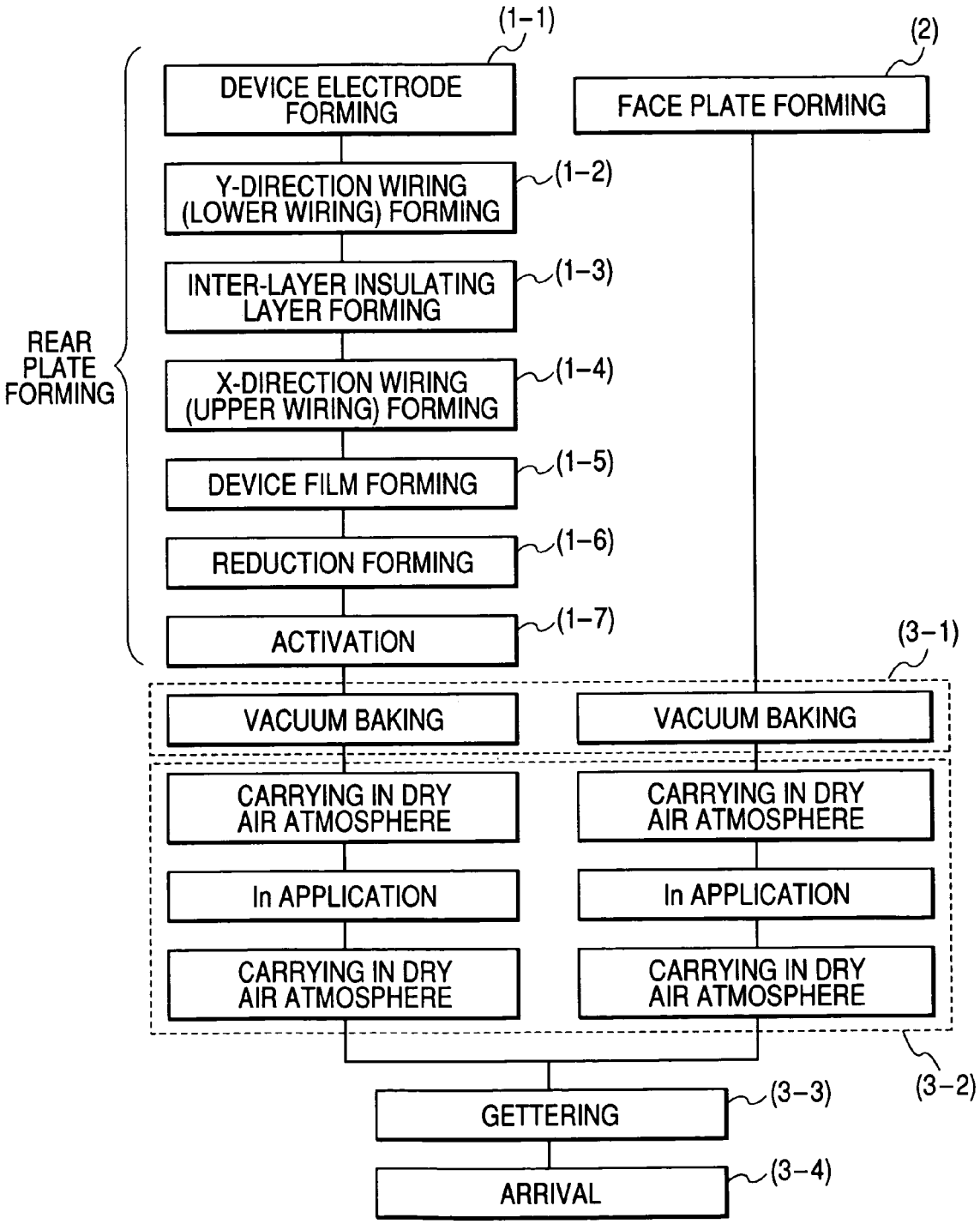
FIG. 4 is a schematic flow chart of a fabricating method for the envelope of the invention.

In the following, the fabricating method for the envelope of the invention will be clarified by a specific example. FIG. 4 schematically shows a sequence of fabricating method. The fabricating method is roughly divided into (1) a fabricating process for the rear plate 3, (2) a fabricating process for the face plate 2, and (3) an assembling process of the envelope, which will be explained in succession in the following. Also details of the structure will be clarified in each explanation.

(1) Fabrication of Rear Plate 3

A fabricating process for the rear plate 3 will be explained with reference to FIGS. 5A, 5B, 5C, 5D and 5E.

Figure 5A:
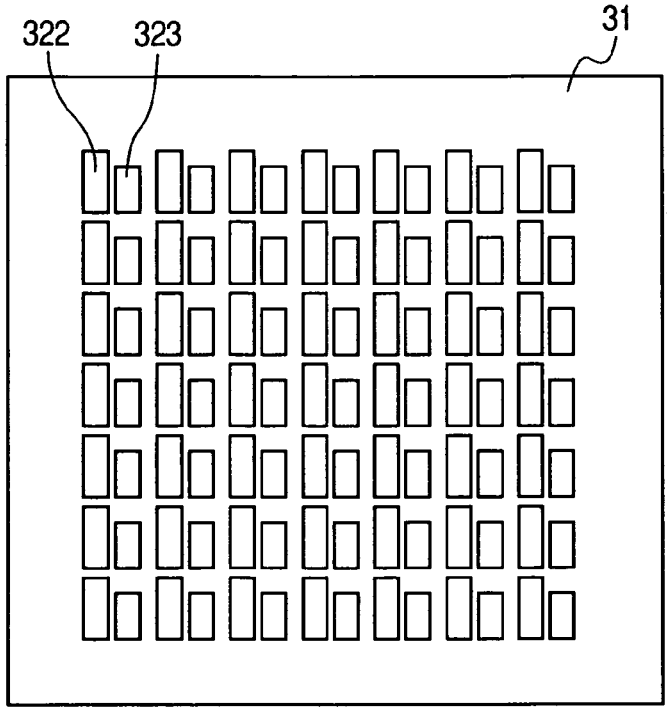
FIG. 5A is a view explaining a fabricating step for a rear plate in the fabricating method for the envelope shown in FIG. 4.

(step 1-1) Formation of device electrode on glass substrate: At first an electron emitting device 32 was prepared on an electron source substrate 31 of the rear plate 3. The electron source substrate 31 in the present example employed an electric glass PD-200 for plasma display of a low alkali content (manufactured by Asahi Glass Co.). As shown in FIG. 5A, on the electron source substrate 31, titanium Ti was sputtered with a thickness of 5 nm as an undercoat layer by sputtering, and then platinum Pt was sputtered thereon with a thickness of 40 nm. Then a photoresist was coated and a patterning was executed by a photolithographic process of exposure, development and etching to form device electrodes 322, 323. In the present example, there were adopted a gap L=10 μm and a device electrode length W=100 μm. The device electrodes 322, 323 can also be formed by coating, for example by offset printing, a commercial paste containing metal particles such as of platinum. Also a more precise pattern can be formed by a process of coating a photosensitive paste containing for example platinum for example by screen printing, and executing an exposure through a photomask and a development. A support frame 36 and a spacer 5 were adhered in advance to the electron source substrate 31.

Figure 5B:
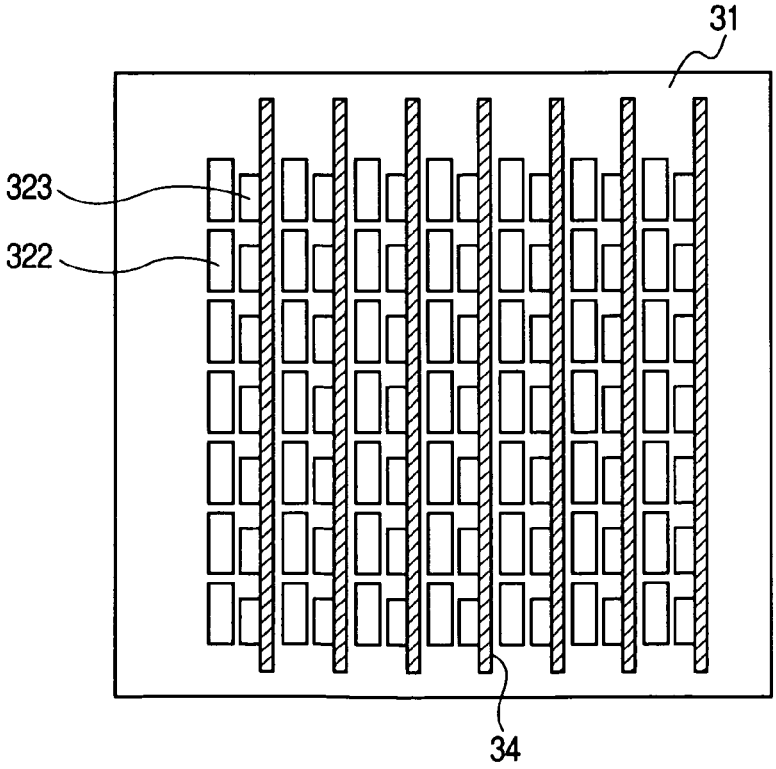
FIG. 5B is a view explaining a fabricating step for a rear plate in the fabricating method for the envelope shown in FIG. 4.

(step 1-2) Formation of Y-direction wiring (lower wiring): Y-direction wirings 34 constituting lower wirings were prepared as shown in FIG. 5B. The Y-direction wiring 34 serving as a common wiring was so formed in a line-shape pattern as to contact either of the device electrodes 322, 323 and mutually connect such electrodes (in the example, so formed as to contact the device electrodes 323). For this purpose, a silver photopaste ink was screen printed, dried, and exposed and developed in a predetermined pattern. It was then baked at a temperature of about 480° C. to complete the wiring. The Y-direction wiring 34 had a thickness of about 10 μm and a width of 50 μm. An end portion was made with a larger width for use as a wiring lead electrode.

Figure 5C:
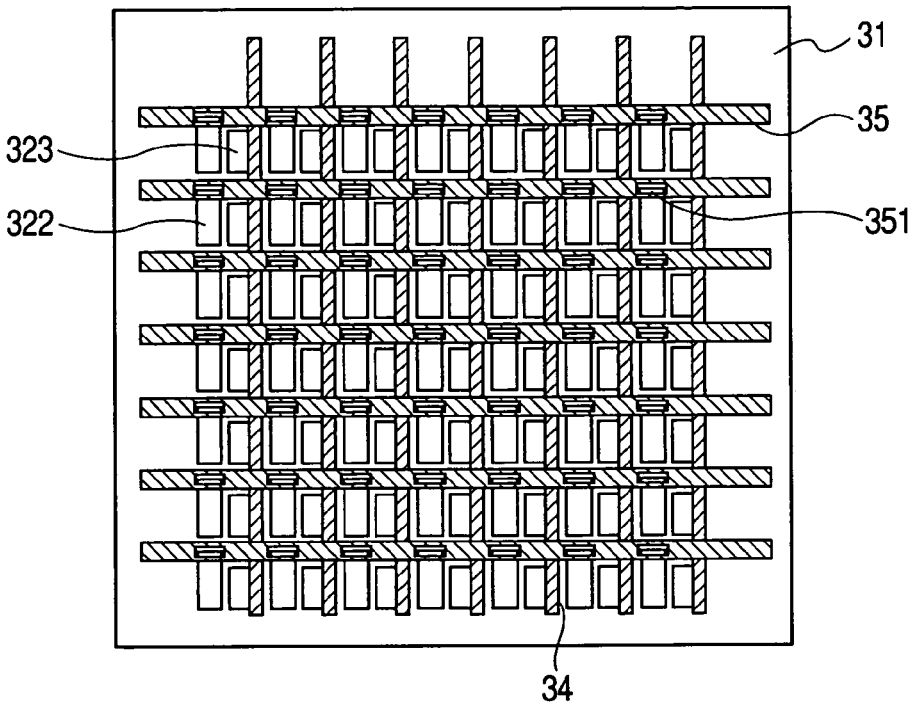
FIG. 5C is a view explaining a fabricating step for a rear plate in the fabricating method for the envelope shown in FIG. 4.

(Step 1-3) Formation of interlayer insulation film: An interlayer insulation film 35 was provided as shown in FIG. 5C, in order to insulating the Y-direction wiring 34 from an X-direction wiring 33 to be explained later. More specifically, it was formed under the X-direction wiring 33, so as to cover a crossing portion with the Y-direction wiring 34 formed in advance with a contact hole 351 for enabling an electrical contact between the X-direction wiring 33 and the other of the device electrodes 322, 323 (device electrode 322 in this example). In more details, a photosensitive glass paste containing PbO as a principal component was screen printed, exposed and developed. This procedure was repeated 4 times, and the obtained coating was finally baked at a temperature of about 480° C. The insulation film 35 had a total thickness of about 30 μm and a width of 150 μm.

Figure 5D:
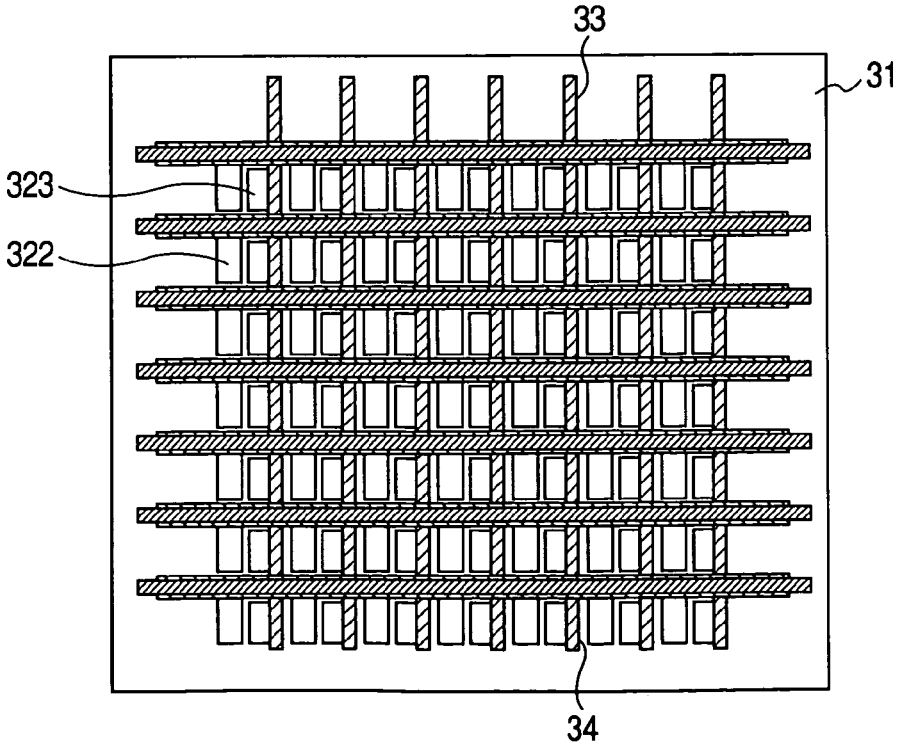
FIG. 5D is a view explaining a fabricating step for a rear plate in the fabricating method for the envelope shown in FIG. 4.

(step 1-4) Formation of X-direction wiring (upper wiring): X-direction wirings 32 constituting upper wirings were prepared as shown in FIG. 5D. It was formed by screen printing and drying an Ag paste ink on the interlayer insulation film 35 formed in advance, then repeating this procedure (coated twice) and executing a baking at a temperature of about 480° C. The X-direction wiring 33 crosses the Y-direction wiring 34 across the interlayer insulation film 35 and is connected through the contact hole 351 in the interlayer insulation film 35 with the other of the device electrodes 322, 323 (device electrode 322 in this example). After a panel formation, the X-direction wirings 33 serve as scanning electrodes. The X-direction wiring 33 had a thickness of about 15 μm. Also a lead wiring and a lead terminal (not shown) to an external drive circuit were prepared in a similar manner. In this manner a substrate bearing XY matrix wiring (X-direction wirings 33 and Y-direction wirings 34) was prepared.

Figure 5E:
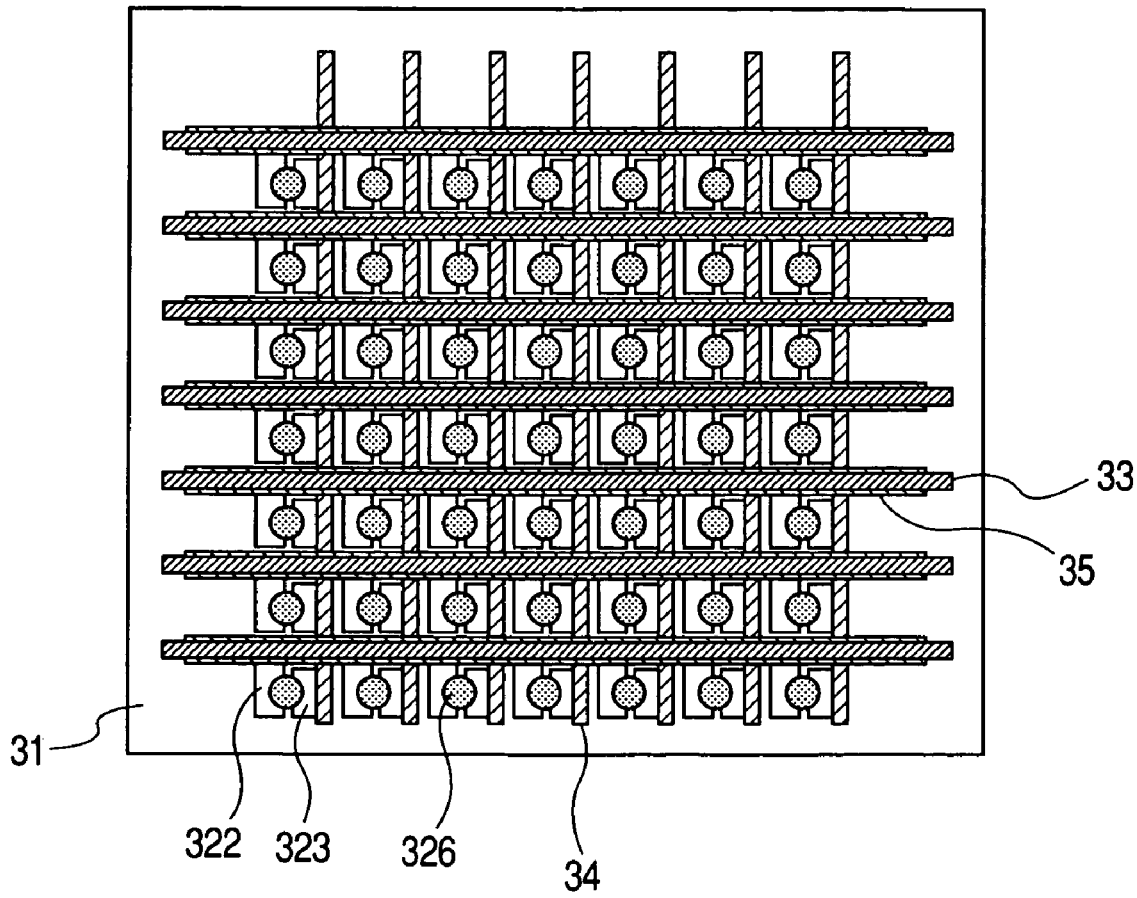
FIG. 5E is a view explaining a fabricating step for a rear plate in the fabricating method for the envelope shown in FIG. 4.

(step 1-5) Formation of device film: A device 326 was prepared as shown in FIG. 5E. The substrate was at first sufficiently cleaned and surface treated with a solution containing a water repellent agent to obtain a hydrophobic surface. This operation intends that an aqueous solution for forming a device film to be coated later is positioned with an adequate spreading on the device electrodes 322, 323. A solution of DDS (dimethyldiethoxysilane) as the water repellent agent was sprayed on the substrate and was dried with a warm air of 120° C. Thereafter, a device film 326 was formed by an ink jet method between the device electrodes 322, 323.

Figure 6A:
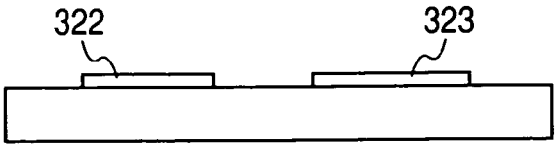
FIGS. 6A, 6B, 6C and 6D are views explaining an ink jet coating step in the fabricating method for the envelope shown in FIG. 4.
Figure 6B:
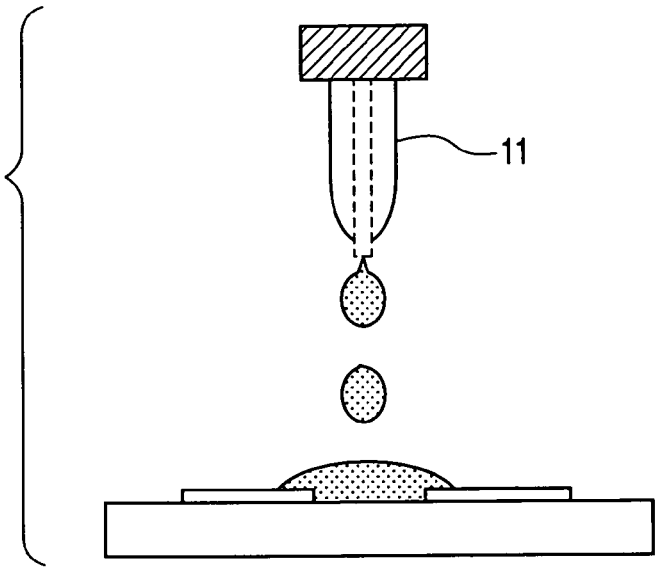

FIGS. 6A and 6B are schematic views showing an ink jet coating step. Between the device electrodes 322, 323 formed on the electron source substrate 31 as shown in FIG. 6A, liquid droplet providing means 11 was set as shown in FIG. 6B, and liquid droplets of a predetermined amount were dropped. In an actual process, in order to compensate a planar fluctuation of the individual device electrodes on the substrate, a positional aberration of the pattern was observed in several positions on the substrate, and the coating was executed by an interpolation by a linear approximation for the amount of aberration between the observed points, thereby achieving an exact coating in the positions corresponding to all the pixels. In the present example, for obtaining a palladium film as the device film 326, an organic palladium containing solution was prepared by dissolving a palladium-proline complex by 0.15 wt. % in a solution formed by water and isopropyl alcohol (IPA) (85:15), and adding certain additives. A droplet of this solution was deposited, utilizing an ink jet discharging apparatus utilizing a piezo element as the liquid droplet providing means 11, so as to obtain a dot diameter of 60 μm between the electrodes. Thereafter, the substrate was baked by heating for 10 minutes at 350° C. to form palladium oxide (PdO). There was obtained a film with a dot diameter of about 60 μm and a thickness of 10 nm at maximum. In this manner, the device film 326 was so formed as to bridge the device electrodes 322, 323. The film formation may also be achieved by a sputtering method or a method of coating a solution following by a baking. Also as the ink jet apparatus, an apparatus utilizing an electrothermal converting element can also be utilized.

Figure 6C:
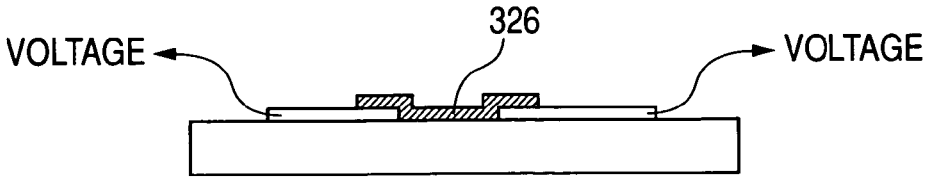
Figure 6D:
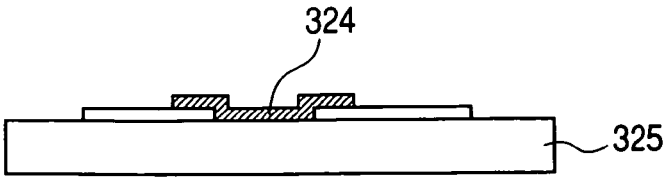

(Step 1-6) Reduction forming: A hood forming process by passing a current through the device film 326 was executed to generate a crack therein, thus forming an electron emitting region 325. More specifically, a hood-shaped cover was placed over the entire substrate except for a lead electrode portion in the peripheral part of the substrate thereby forming a vacuum space on the substrate, and a voltage is applied between the X-direction wiring 33 and the Y-direction wiring 34 from an external power source through the electrode terminals (cf. FIG. 6C) to pass a current between the device electrodes 322, 323 thereby locally destructing, deforming or denaturing the device film 326 and forming an electron emitting region 325 of an electrically high resistance (cf. FIG. 6D). Except for the electron emitting region 325, the device film 326 forms an electroconductive film 324. In this operation, a heating under current passing in a vacuum atmosphere containing certain hydrogen gas accelerates a reduction by hydrogen, thereby changing palladium oxide into a palladium film. A position and a shape of such crack are significantly influenced by the uniformity of the original film, but, in order to suppress fluctuations in the characteristics of many devices, it is particularly desirable that the crack is generated in a central portion and is formed in a linear shape as far as possible.

An electron emission takes place under a predetermined voltage from the vicinity of thus generated crack, but, since the emission efficiency is still very low in this state, an activation process to be explained later is required. The obtained electroconductive film 324 has a resistance of $10^2$ to $10^7$ Ω.

Figure 7A:
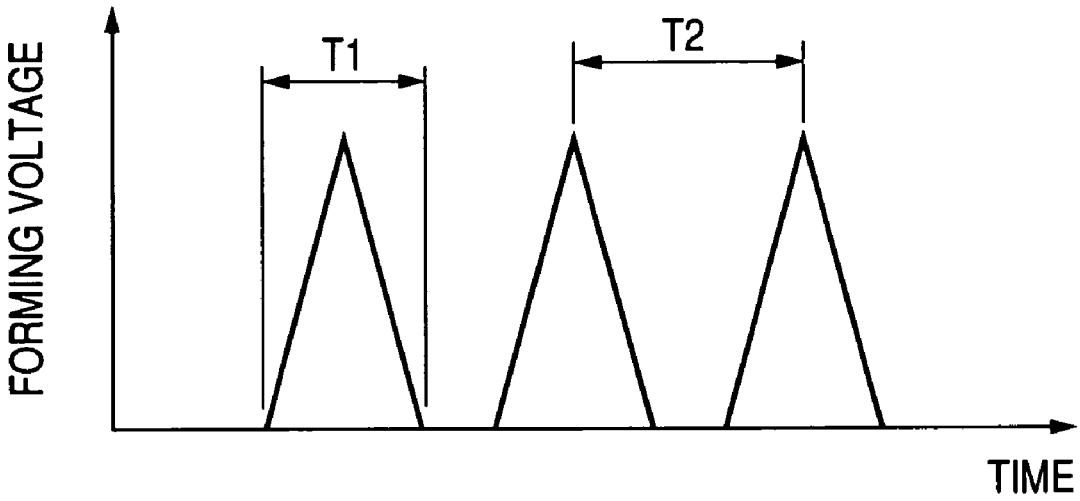
FIGS. 7A and 7B are charts showing voltage wave forms employed in a forming process in the fabricating method for the envelope shown in FIG. 4.
Figure 7B:
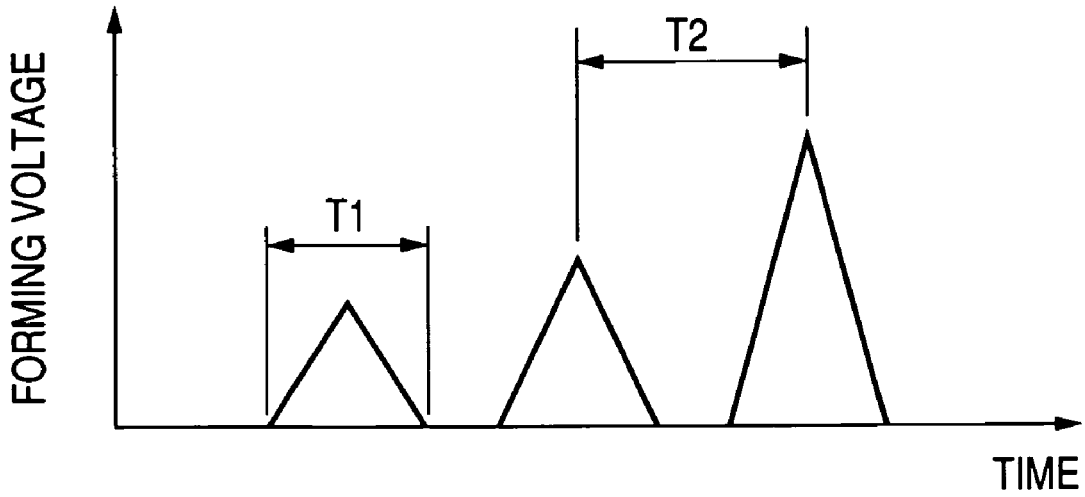

In the following, a voltage wave form employed in the forming process will be briefly explained. FIGS. 7A and 7B show a voltage wave form as a function of time. The voltage, applied in a pulsed wave form, may be applied in pulses of a constant pulse height (cf. FIG. 7A) or in pulses of an increasing pulse height (cf. FIG. 7B). In FIGS. 7A and 7B, a pulse width T1 of the voltage wave form is preferably 1 μsec to 10 msec, and a pulse interval T2 is preferably 10 μsec to 100 msec. In case of FIG. 7A, a wave height of a triangular wave (peak voltage at forming) is suitably selected. In case of FIG. 7B, a wave height of a triangular wave (peak voltage at forming) is stepwise increased for example with a step of about 0.1 V.

In the forming process, a pulsed voltage not causing a local destruction or deformation of the device film 326 for example about 0.1 V was inserted, between the forming pulses, for measuring a device current to determine a resistance, and the process was terminated when the resistance reached for example 1000 times of the resistance before the forming process.

(Step 1-7) Activation (carbon deposition): As the electron emitting efficiency in this state is still very low as explained above, the device was subjected to a process called activation. More specifically, under a suitable vacuum containing an organic compound, a hood-shaped cover was placed, as in the forming step, on the substrate to form a vacuum space thereon and a pulsed voltage was applied repeatedly between the device electrodes 322, 323 through the X-direction wiring 33 and the Y-direction wiring 34. Then a gas containing carbon atoms was introduced and carbon or a carbon compound derived therefrom was deposited as a carbon film in the vicinity of the crack. Trinitrile employed as a carbon source was introduced through a slow leak valve into the vacuum space and was maintained at a pressure of $1.3\times10^{-4}$ Pa. A pressure of the introduced trinitrile, though somewhat influenced by a shape of a vacuum apparatus or members used therein, is preferably about $1\times10^{-5}$ to $1\times10^{-2}$ Pa.

Figure 8A:
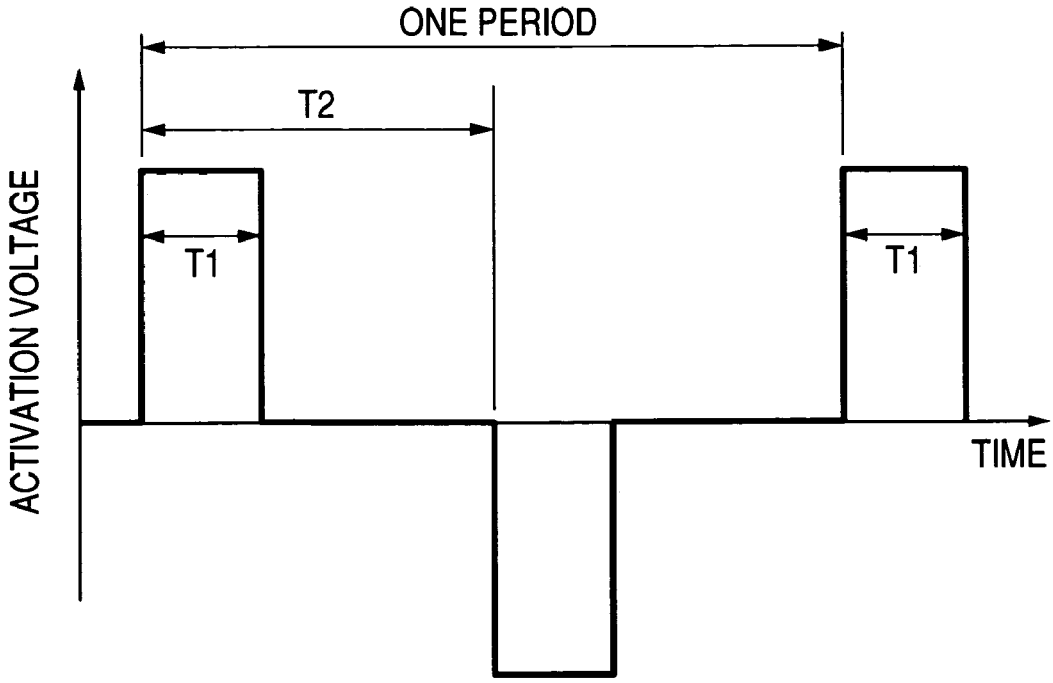
FIGS. 8A and 8B are charts showing voltage wave forms employed in an activation process in the fabricating method for the envelope shown in FIG. 4.
Figure 8B:
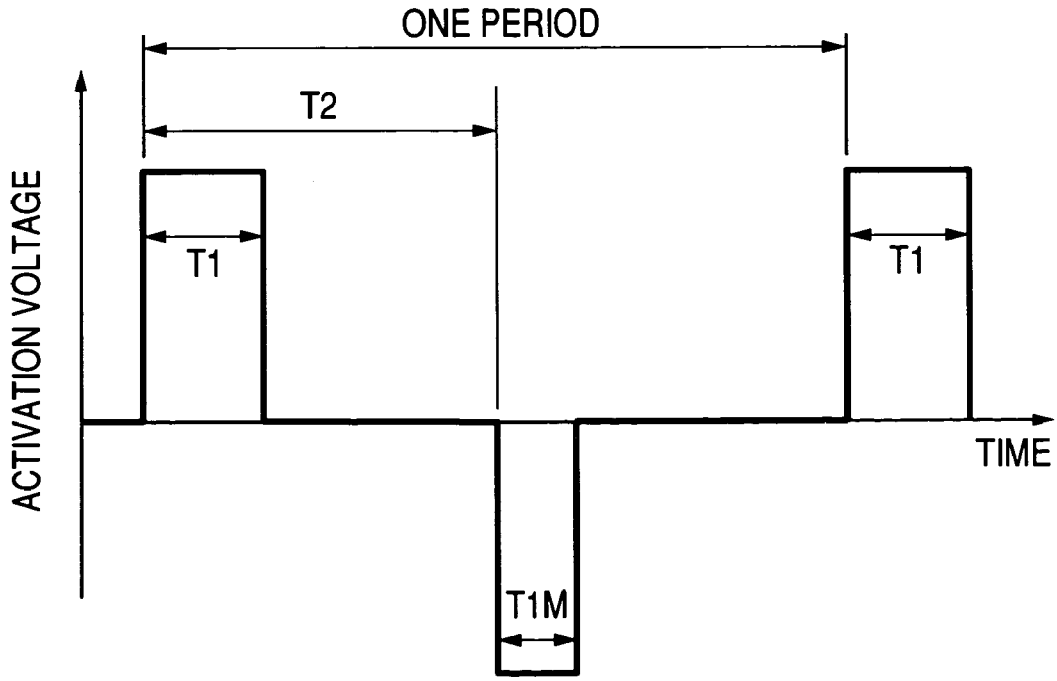

FIGS. 8A and 8B show a preferred example of a voltage application employed in the activation process. A maximum voltage to be applied is suitably selected within a range of 10 to 20 V. In FIG. 8A, T1 indicates a width of positive and negative pulses in the voltage wave form, and T2 indicates a pulse interval, wherein the voltages have a same absolute value in the positive and negative sides. In FIG. 8B, T1 and T1M respectively indicate widths of positive and negative pulses, and T2 indicates a pulse interval, wherein T1>T1M and the voltages have a same absolute value in the positive and negative sides.

The voltage given to the device electrode 323 is positive, and the device current If is taken positive in a direction from the device electrode 323 to the device electrode 322. The current was terminated when the emission current became almost saturated after about 60 minutes, and the slow leak valve was closed to terminate the activation process. Through the above-described process, a rear plate 3 having the electron emitting device 32 was prepared.

(2) Fabrication of Face Plate

As the glass substrate 21 of the face plate 2, as in the rear plate 3, there was employed an electric glass PD-200 for plasma display of a low alkali content (manufactured by Asahi Glass Co.). This material is free from a coloration of the glass, and, with a thickness of about 3 mm, can sufficiently secure a shielding effect for suppressing the leakage of a soft X-ray generated secondarily even in a drive with an accelerating voltage of 10 kV or higher. Then a fluorescent film 22 was prepared by a precipitation method of a printing method, then a smoothing process (called filming) of an internal surface of the fluorescent film 22 was conducted, and Al was deposited for example by vacuum evaporation to obtain a metal back 23.

(3) Fabrication of Envelope (Step 3-1) Vacuum baking: The face plate 2 and the rear plate 3 were respectively vacuum baked. The vacuum baking is to eliminate gas, water, oxygen and the like generated in the activation process (step 1-7). The face plate 2 and the rear plate 3 may be baked in a same vacuum baking apparatus, but may be baked separately. The vacuum baking was executed at about 370 to 430° C. in a vacuum baking apparatus constituting a first chamber.

(Step 3-2) Carrying to sealing apparatus: At first the temperature was lower to about 140° C., and a leakage of the vacuum baking apparatus was executed. Then a carrying to a sealing apparatus serving as a second chamber and provided with a getter flushing mechanism was executed in an atmosphere formed by heating dry air of a dew point of 0° C. to 140° C. The glass substrate 21 and the electron source substrate 31 are carried in a state maintained at a temperature of 140° C.

The air having a dew point of 0° C. was employed because a moisture amount was about 1 ppm in a room temperature condition, and also a heating of such air having a dew point of 0° C. to 140° C. allows to avoid deposition of substances possibly affecting the vacuum level such as unnecessary moisture even with a carrying in vacuum or in an inert gas atmosphere. As a result, there can be dispensed with an additional facility for forming vacuum and safety measure required in the use of an inert gas. Also the use of the dry air realizes a substantially uniform temperature distribution in the face plate 2 and the rear plate 3, thereby significantly reducing the troubles such as a cracking of the spacer 5 and a bending of the rear plate 2 on which the spacer 5 is mounted. The dew point is not restricted in the lower limit as it is preferably as low as possible, and, for example, an often employed dry air of a dew point of −80° C. has an extremely low moisture content of about 1 ppm at the room temperature, and can further reduce the influence on the vacuum level.

Theoretically, a dewing does not occur in a dry air of a temperature equal to or higher than the dew point, but a margin is preferably given to the heating temperature since there may result a fluctuation in the dew point by an impurity in the air or a dew by a local temperature change. For this reason, a heating temperature of 140° C. was employed for the dry air of a dew point of 0° C., but this is merely an example and other combinations of the dew point and the heating temperature are also possible. However it is impractical that the temperature of the dry air in the carrying process exceeds the maximum temperature of the baking process, so that the temperature of the dry air in the carrying process is so selected as not to exceed the maximum temperature of the baking process.

In the course of the carrying, In films 6 were soldered to both contact faces of the glass substrate 21 and the support frame 36. A thickness of the In film 6 was so regulated that a summed thickness of the In films 6 formed on the glass substrate 21 and the support frame 36 is sufficiently larger than a thickness of the In film 6 after adjoining. In the present example, an In film 6 of a thickness of 300 μm was formed on each of the glass substrate 21 and the support frame 36 in order to obtain a thickness of 300 μm in the In film 6 after adjoining. Thereafter, carrying was continued to the sealing apparatus.

As the face plate 2 and the rear plate 3 are carried in a dry air atmosphere, it is rendered possible, different from a carrying in vacuum as in the prior technology, to coat the In film 6 in the course of the carrying thereby increasing the freedom of the process. The coating of the In film 6 may be executed any time when the vacuum is released, for example before the carrying or after the carrying. However, in case a getter process to be explained later is executed, the coating has to be executed prior to such getter process executed in vacuum.

(Step 3-3) Getter process: A getter process may be executed in order to obtain a vacuum of $10^{-6}$ Torr (about $1.3\times10^{-4}$ Pa) or less when the envelope 1 is sealed and to maintain the vacuum state after the sealing of the envelope 1. This process is executed, immediately before or after the sealing of the envelope 1, by heating a getter provided in a predetermined position in the envelope 1 for example by a resistance heating method or a high frequency heating method thereby forming an evaporated film. The getter is usually constituted principally of Ba, and maintains a vacuum of $1\times10^{-5}$ to $1\times10^{-7}$ Torr (about $1.3\times10^{-3}$ to $1.3\times10^{-5}$ Pa) by an adsorbing function of the evaporated film.

In the example, the sealing apparatus received the face plate 2 and the rear plate 3 in an opposed state at 140° C. and the sealing apparatus was evacuated. Then, in a state where the face plate 2 and the rear plate 3 in the opposed state were maintained at a predetermined gap, a current was passed through a ribbon-shaped getter, filled with an evaporation getter material (not shown) principally constituted of Ba to cause a flushing by an induction heating thereby forming an evaporation type getter 25 with a thickness of 30 nm. An evaporation type getter was employed because a non-evaporation getter is activated in the vacuum baking, thus adsorbing CO, $CO_2$ etc. in the dry air in the carrying process and being deteriorated in the performance. Such getter can be reactivated as a getter in case the sealing temperature is 200° C. or higher, but it will remain sealed in a deteriorated state as the present example executes the sealing at 200° C. or lower as will be explained later. On the other hand, an evaporation type getter has to be formed in vacuum at a temperature equal to or lower than 200° C., and the example employed an evaporation type getter in consideration of these facts.

Figure 9:
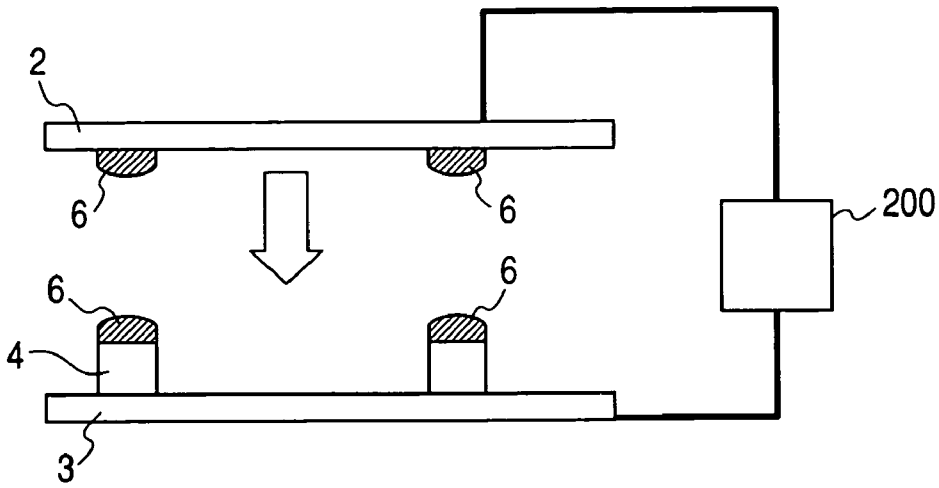
FIG. 9 is a view explaining an adjoining method for the rear plate and the face plate in the fabricating method for the envelope shown in FIG. 4.

(Step 3-4) Sealing step: The face plate 2 and the rear plate 3 were sealed and adjoined. More specifically, as shown in FIG. 9, both substrates were heated to 160° C. to fuse the In films 6, and were maintained in a sufficiently horizontal state in order that the fused In does not flow. When the temperature was elevated to 160° C. higher than the melting point of In, the gap of the face plate 2 and the rear plate 3 was gradually reduced by a positioning apparatus 200 to adjoin and seal the both substrates.

Particularly in a color image display apparatus, as the fluorescent member of each color has to be aligned with each electron emitting device, a sufficient aligning operation is required for example by impingements of the upper and lower substrates. Also the temperature at the sealing is only required to be equal to or higher than the melting point of indium and is not limited to 160° C. mentioned above, but is selected lower than the maximum temperature of the baking step, since the sealing operation is preferably executed at a better vacuum state than at the vacuum baking operation.

A fabricating method for the envelope has been explained in detail, but the fabricating method for the envelope of the present invention is not limited to the foregoing embodiment or example. For example, the example employed an adjoining of the support frame 36 and the rear plate 3 by frit glass, such adjoining may also be executed with In to realize an adjoining process at a lower temperature. Also the In coating step may be executed prior to the baking step. Also after the baking step, there may be formed getters of two different kinds respectively constituted principally of Ba and Ti.

Figure 10:
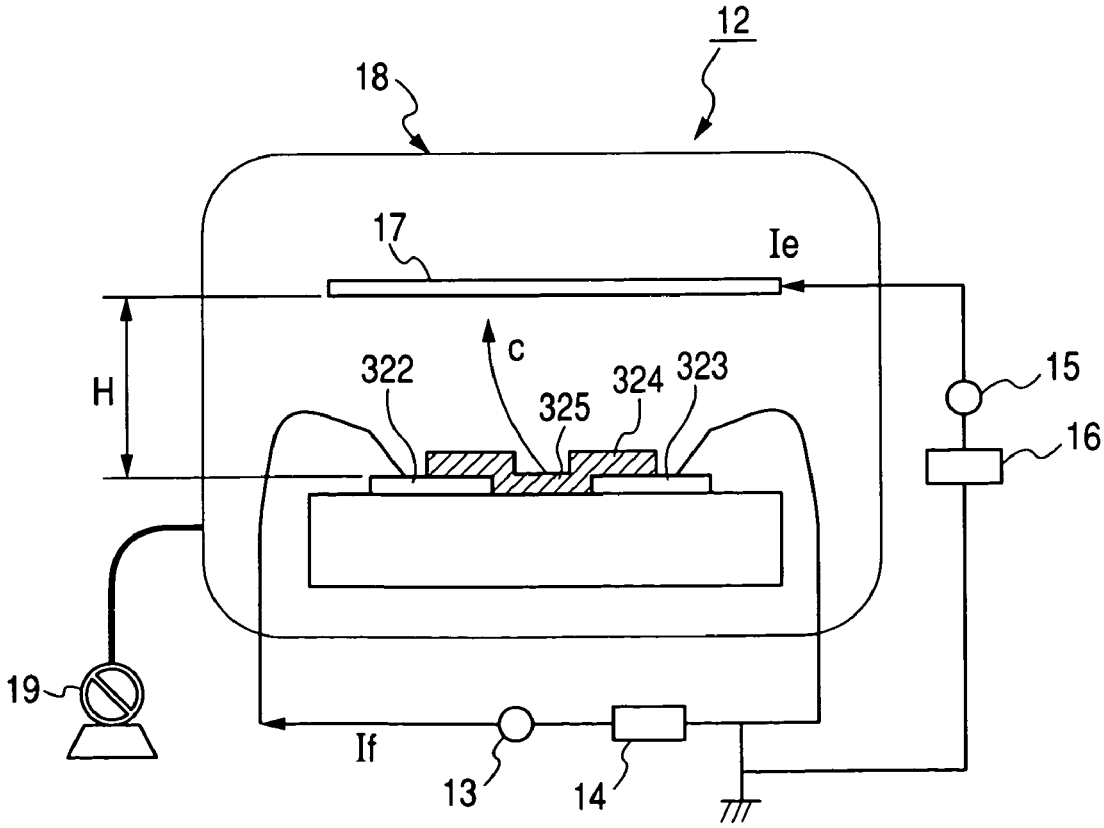
FIG. 10 is a schematic view showing a measuring-evaluating apparatus for measuring electron emitting characteristics of an electron emitting device.

Now there will be explained, with reference to FIGS. 10 and 11, basic characteristics of the electron emitting device 32 having the aforementioned device structure and prepared by the aforementioned process. FIG. 10 is a schematic view of a measurement-evaluation apparatus 12 for measuring the electron emitting characteristics of the electron emitting device 32 of the aforementioned configuration. The measurement-evaluation apparatus 12 can measure a device current If flowing between the device electrodes 322, 323 of the electron emitting device 32, and an emission current Ie to an anode 17. The device electrodes 322, 323 are connected to a power source 13 and an ammeter 14. The power source 13 applies a device voltage Vf to the electron emitting device 32. The ammeter 14 measures a device current If flowing in the electroconductive film 324, including the electron emitting region 325, between the device electrodes 322, 323. Above the electron emitting device 32, there is provided an anode electrode 17 connected to a power source 15 and an ammeter 16. The anode 17 captures an emission current Ie emitted from the electron emitting region 325 of the electron emitting device 32. The power source 15 applies a voltage to the anode 17. The ammeter 16 measures an emission current Ie emitted from the electron emitting region 325 of the device.

The electron emitting device 32 and the anode 17 are installed in a vacuum apparatus 18, which is equipped with necessary equipment therefor, such as an exhaust pump 18 and a vacuum gauge and is rendered capable of measurement and evaluation of the electron emitting device 32 under a desired vacuum. The measurement was conducted with a voltage of the anode 17 within a range of 1 to 10 kV and a distance H (cf. FIG. 10) of the anode and the electron emitting device within a range of 2 to 8 mm.

Figure 11:
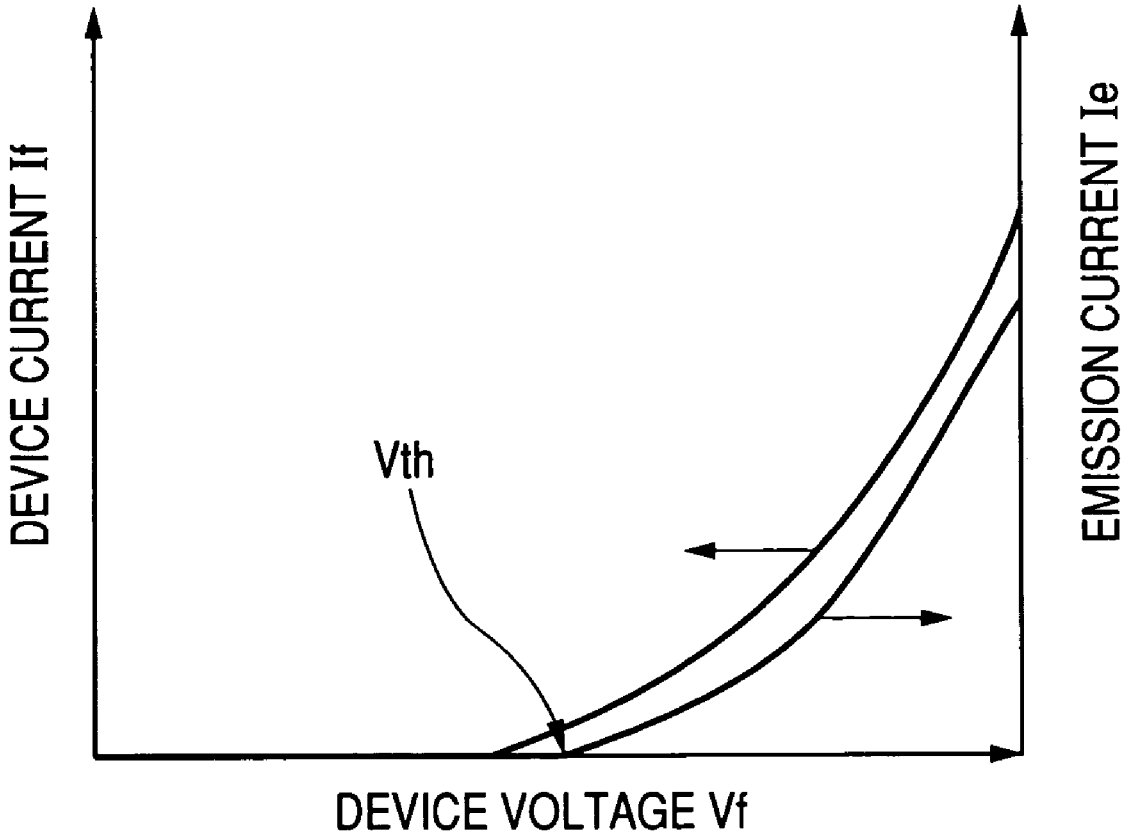
FIG. 11 is a chart showing a relationship between a device current and a device voltage in an electron emitting device in the envelope of the invention.
Figure 12:
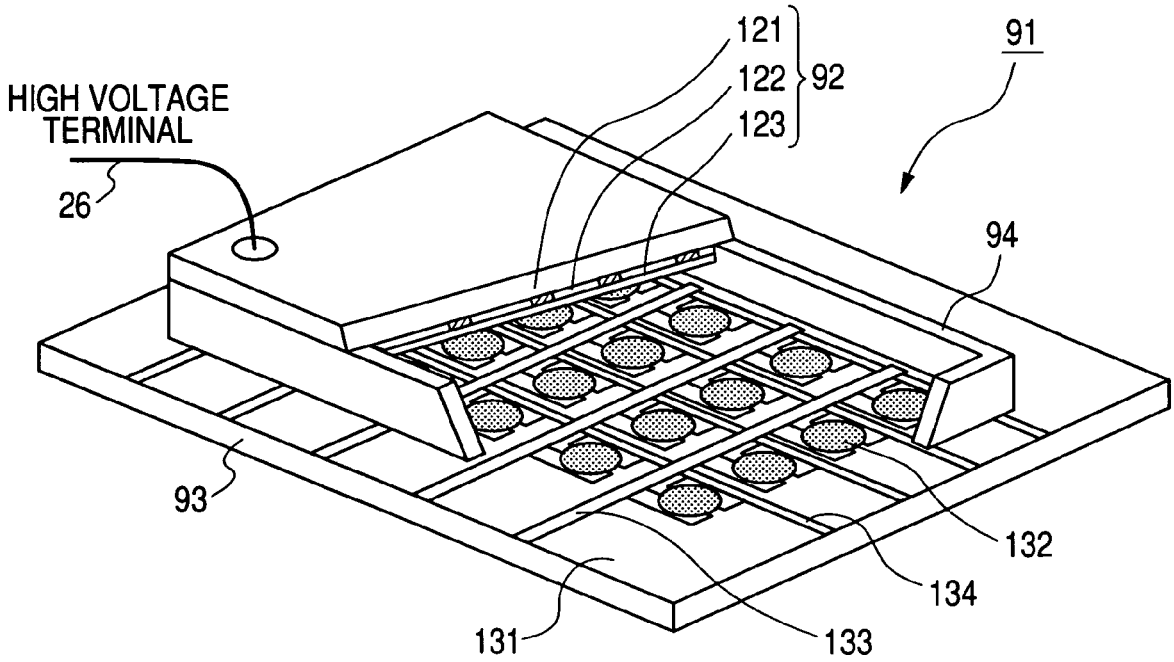
FIG. 12 is a schematic view showing an envelope by a prior technology.
Figure 13A:
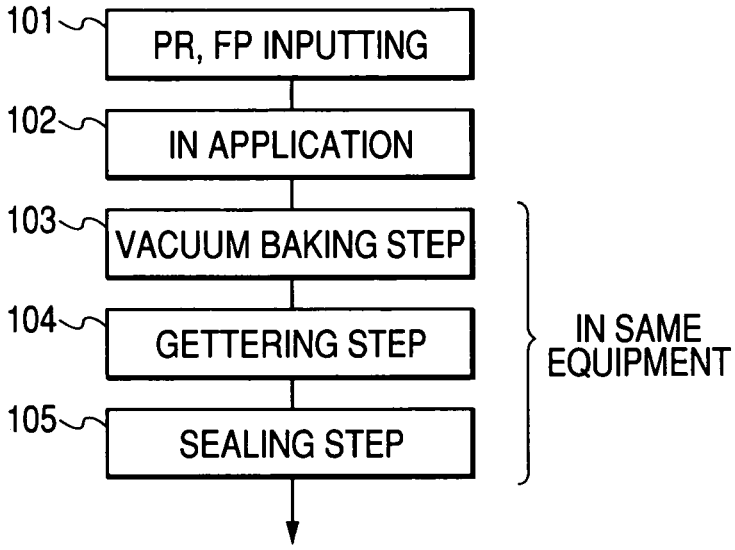
FIGS. 13A and 13B are views showing an example of a fabricating procedure for an envelope by a prior technology.
Figure 13B:
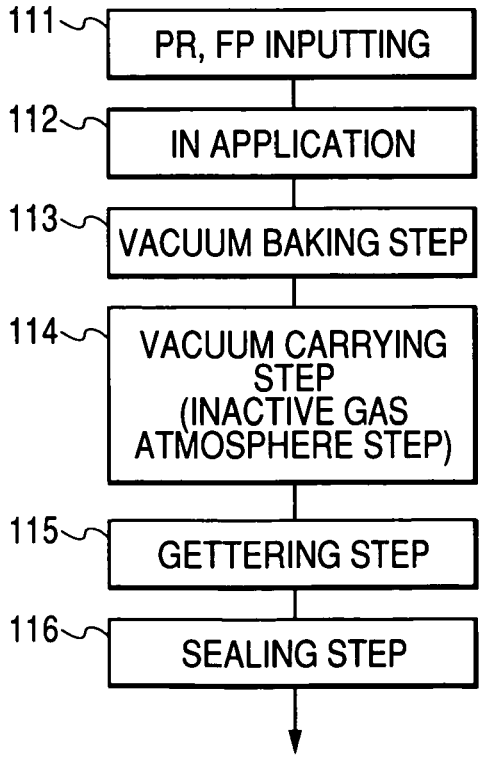

FIG. 11 shows a typical example of a relationship of the emission current Ie, the device current If and the device voltage Vf measured by the measurement-evaluation apparatus 12. Although the emission current Ie and the device current If are significantly different in magnitude, but FIG. 11 represents the ordinate on an arbitrary linear scale, for the purpose of a qualitative comparison of changes in If and Ie.

A measurement under a voltage application of 12 V between the device electrodes 322, 323 provided an average emission current Ie of 0.6 μA and an average electron emission efficiency of 0.15%. Also the devices showed satisfactory uniformity, with a fluctuation of 5% in Ie among the devices.

As explained in the foregoing, the method of the present invention has a wide freedom in the process, allows to use inexpensive apparatuses and can safely provide an envelope. Also it can provide an image display device of a satisfactory display quality, and thus provide an image display apparatus of a high vacuum level with electron emitting devices of a high performance.

This application claims priority from Japanese Patent Application No. 2004-120208 filed Apr. 15, 2004, which is hereby incorporated by reference herein.

What is claimed is:

1. A method for fabricating an envelope formed by sealing first and second members, the envelope having a vacuum space therein, the method comprising:

a baking step of baking the first and second members in vacuum in a first chamber;

a carrying step of carrying the baked first and second members from the first chamber to a second chamber in an atmosphere in which an air having a predetermined dew point is maintained at a temperature exceeding the dew point; and a sealing step of sealing the first and second members in vacuum in the second chamber thereby forming the envelope.

2. The fabricating method according to claim 1, wherein the predetermined dew point is equal to or lower than 0° C.

3. The fabricating method according to claim 1, wherein a maximum temperature in the sealing step is lower than a maximum temperature of the baking step.

4. The fabricating method according to claim 3, wherein an air temperature in the carrying step is lower than a maximum temperature in the baking step.

5. The fabricating method according to claim 1, further comprising a step of forming a getter on the image forming member, either in the course of the carrying step or before the sealing step.

6. A method for fabricating an image display apparatus including an envelope having first and second members opposed to each other, the envelope having a vacuum space therein, and a matrix-shape wiring and an image forming member provided in the envelope, wherein the envelope is fabricated by the method according to claim 1.

7. The fabricating method according to claim 6, wherein the matrix-shape wiring is connected to a plurality of electron emitting devices, and the image forming member includes a phosphor and an electron accelerating electrode.

* * * * *

UNITED STATES PATENT AND TRADEMARK OFFICE

CERTIFICATE OF CORRECTION

PATENT NO. : 7,195,533 B2
APPLICATION NO. : 11/099579
DATED : March 27, 2007
INVENTOR(S) : Mitsutoshi Hasegawa It is certified that error appears in the above-identified patent and that said Letters Patent is hereby corrected as shown below:

ON COVER PAGE AT (57) ABSTRACT

Line 4, “and” should read --and second--; and
Line 10, “an” should be deleted.

COLUMN 2

Line 47, “an” (second occurrence) should be deleted.

COLUMN 4

Line 16, “an” (second occurrence) should be deleted; and
Line 36, “in economicality” should read --economically--.

COLUMN 5

Line 51, “maintain” should read --maintaining--.

COLUMN 8

Line 40, “a” (first occurrence) should be deleted.

COLUMN 11

Line 11, “a” (second occurrence) should be deleted.

UNITED STATES PATENT AND TRADEMARK OFFICE

CERTIFICATE OF CORRECTION

PATENT NO. : 7,195,533 B2
APPLICATION NO. : 11/099579
DATED : March 27, 2007
INVENTOR(S) : Mitsutoshi Hasegawa It is certified that error appears in the above-identified patent and that said Letters Patent is hereby corrected as shown below:

COLUMN 14

Line 5, "an" (second occurrence) should be deleted.

Signed and Sealed this

Twenty-ninth Day of April, 2008

JON W. DUDAS
*Director of the United States Patent and Trademark Office*